United States Patent [19]

Kingsley et al.

[11] Patent Number: 4,848,918

[45] Date of Patent: Jul. 18, 1989

[54] MIXING APPARATUS

[75] Inventors: George Kingsley, Danvers; Christopher Shallice, Southborough, both of Mass.

[73] Assignee: CF Systems Corporation, Waltham, Mass.

[21] Appl. No.: 228,941

[22] Filed: Aug. 4, 1988

[51] Int. Cl.[4] ..... B01F 5/12

[52] U.S. Cl. ..... 366/262; 366/164

[58] Field of Search ..... 366/279, 266, 264, 265, 366/262, 270, 307, 137, 150, 155, 159, 164, 176, 102, 103; 196/14.52; 55/317

[56] References Cited

U.S. PATENT DOCUMENTS

| | | | |
|---|---|---|---|
| 754,931 | 3/1904 | Meyrick | 366/164 |
| 897,481 | 9/1908 | Pease | 366/164 |
| 2,991,983 | 7/1961 | Logan | 366/270 |
| 3,222,141 | 12/1965 | Donaldson | 366/307 |
| 3,806,619 | 4/1974 | Zosel | 426/478 |
| 4,402,715 | 9/1983 | Ruyak | 55/317 |
| 4,434,028 | 2/1984 | Eppig | 196/14.52 |
| 4,676,654 | 6/1987 | Fleckner | 366/98 |

*Primary Examiner*—Robert W. Jenkins

*Attorney, Agent, or Firm*—Schiller, Pandiscio & Kusmer

[57] ABSTRACT

Apparatus for mixing materials, including a fluid, in a vessel, which apparatus includes a hollow elongated shaft mounted so as to be driven at one end for rotation about its axis of elongation within the vessel, the other end of the shaft in the vessel being open. A planar baffle plate extends across the vessel intermediate the ends of and transversely to the shaft so as to divide the vessel's interior into two zones joined by the fluid pervious clearance around the edge of the plate. The open end of the shaft is located in one of the zones; the walls of that portion of the shaft located in the second of the zones are perforated to permit fluid flow between the second zone and the shaft interior. A turbine impeller is also mounted on the shaft adjacent the open end of the latter so as to be rotatable with the shaft for creating a relatively low pressure in the volume of materials and fluid disposed immediately adjacent the open end of the shaft.

12 Claims, 1 Drawing Sheet

MIXING APPARATUS

Figure 2:
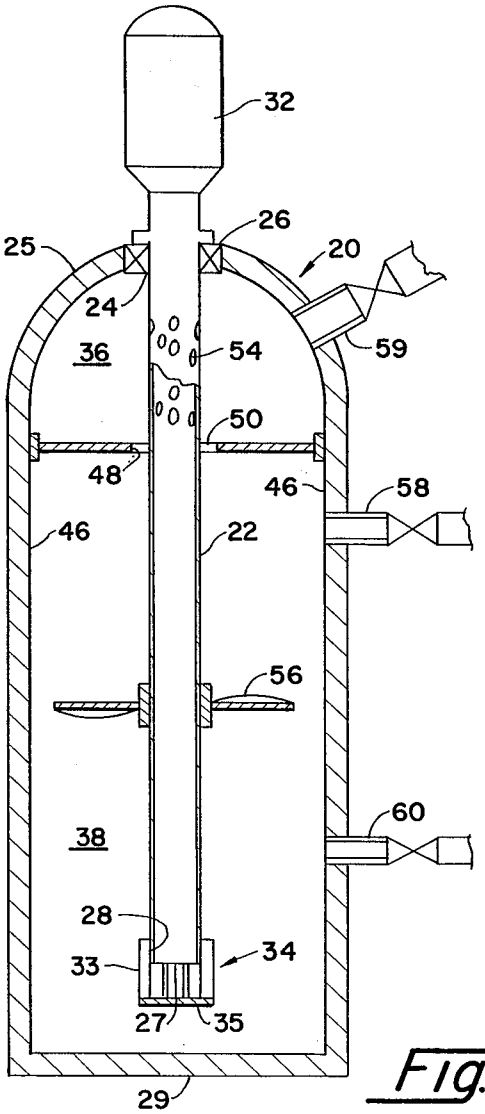

The present invention relates generally to mixing devices and more particularly to mixing apparatus that substantially improves extractions of beds of particulate materials by fluid extractants.

A number of known devices include a stirring mechanism driven in rotation by a hollow shaft. Early mixing devices, such as churns and the like, were formed with hollow dasher shafts to introduce air into the churned mixture. The concept was adopted in other devices, for example as described in U.S. Pat. No. 4,676,654, to form a stirring mechanism having a rotatable hollow shaft for charging a gas into the contents of a pressure vessel. Another device, such as is described in U.S. Pat. No. 4,402,715, provides a separator mechanism having a rotatable hollow shaft through which a gas/oil mixture to be separated is fed into a pressure vessel. U.S. Pat. No. 2,991,983 describes means for stirring sludge tanks to improve sludge digestion, the stirring mechanism employing a hollow, rotatable shaft having a propeller mounted inside the shaft for driving sludge through the shaft and out through one or more jets, a rake mechanism being mounted on the exterior of the shaft for rotation therewith to avoid accumulation of grit in the bottom of the tank.

In extraction of particulate materials such as a sludge with an extractant fluid, it is desirable to use mixing apparatus that will create a high rate of flow of the extractant over the particulates, thereby optimizing the extraction rate. A principal object of the present invention is therefore to provide a novel and improved mixing apparatus, particularly adapted for extracting particulate materials with an extractant fluid. Another object of the present invention is to provide apparatus that improves the recirculation flow of extractant fluid through a mass of particulates.

Briefly, to accomplish these and other objects, the present invention is embodied in apparatus comprising a pressure vessel in which there is mounted a stirring mechanism adapted to be driven by a motor. The stirring mechanism includes means for continuously recirculating fluid through the vessel and to this end comprises a hollow elongated shaft driven in rotation by the motor and extending preferably vertically into the pressure vessel. The upper end of the shaft, which is coupled to the motor, preferably is closed, the other or lower end being perforated for providing communication between the interiors of the vessel and the shaft.

Circulation of material, particularly fluid, through the interior of the shaft is driven by a plurality of impeller vanes mounted on the shaft about its lower or perforated end, the vanes extending outwardly from the shaft. Rotation of the vanes with the shaft creates, adjacent the lower end of the shaft, a relatively low pressure region in the material being mixed, thereby drawing fluid through the latter. The rotation of the vanes also creates, out toward the outside walls of the vessel, a relatively high pressure region in the material being mixed.

Dividing means in the form of a plate extend across said vessel intermediate the ends of the shaft substantially transversely to its axis of elongation, and serve to divide the interior of said vessel into two zones communicating through a substantially fluid pervious clearance past an edge of the plate. When the apparatus is used for solvent extraction, one of the zones, typically the lower zone, is a solids-rich zone, the other or upper zone being solvent-rich. The plate can be mounted on the shaft for rotation therewith and is dimensioned to provide a substantial clearance for fluids between the periphery of the plate and the interior wall of the vessel. In another embodiment, the external periphery of the plate is sealed to the interior wall of the vessel, and the plate includes a central aperture through which the shaft extends, the plate being dimensioned to provide a substantial fluids clearance between the internal periphery of that central aperture and the shaft.

The wall of that portion of the shaft that is located between the plate and the upper or closed end of the shaft, is highly porous, preferably foraminate, and typically is perforated by a plurality of apertures providing low resistance to fluid flow. Material driven outwardly to the walls of the vessel by the impeller vanes travels toward the plate, and solids impacting the plate are kept within the solids-rich zone. Fluids readily, however, travel around the edges of the plate into the solvent-rich zone and can be drawn from the latter through the apertures in the upper portion of the shaft to be recirculated from the lower perforated end of the latter.

In one embodiment, a propeller is mounted on the exterior of and intermediate the ends of the shaft so as to be driven by rotation of the shaft, thereby serving to generally circulate materials within the solids-rich zone.

Other objects of the invention will in part be obvious and in part will appear hereinafter. The invention accordingly comprises the apparatus possessing the construction, combination of elements and arrangement of parts which are exemplified in the following detailed disclosure, and the scope of the application of which will be indicated in the claims.

Figure 1:
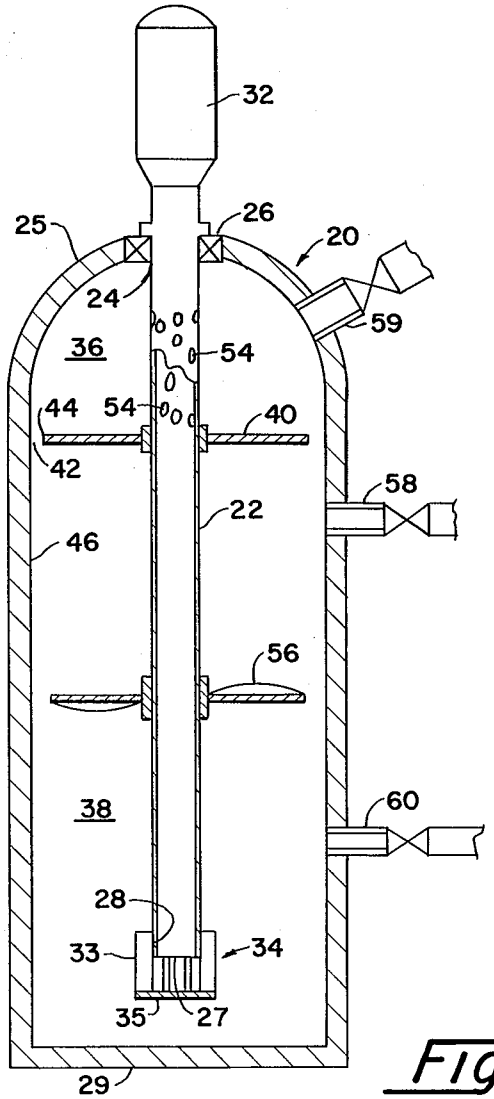

For a fuller understanding of the nature and objects of the present invention, reference should be had to the following detailed description, taken in connection with the accompanying drawings wherein:

FIG. 1 is a schematic, cross-sectional view, partly cut away, of apparatus embodying the principles of the present invention; and FIG. 2 is a schematic, cross-sectional view, partly cut away, showing an alternative embodiment of the present invention.

Referring now to the drawings wherein like numerals denote like parts, there is shown in FIG. 1 a schematic embodiment of the present invention incorporated into vessel 20, the latter preferably being a pressure vessel. Hollow, elongated, substantially straight shaft 22, typically formed of any of a number of metal alloys such as stainless steel, or composite materials and the like, extends, in the form shown, downwardly into the interior of vessel 20 through opening 24 in wall portion 25 (here shown as the top) of vessel 20, shaft 22 being preferably supported by bearings 26 mounted in opening 24 so that the shaft is rotatable about its axis of elongation. The driven or upper end 30 of shaft 22 is coupled to motor 32 so as to be rotatable by the latter and is typically closed. The lower or free end 28 of shaft 22 extends into vessel 20 to a point adjacent wall portion 29 (here shown as the bottom) opposite to wall portion 25 and has one or more openings or perforations 27 that permit fluid communication between the interiors of the shaft and the vessel.

In order to provide a relatively low pressure volume adjacent open end 28 of shaft 22 within a fluid slurry or sludge disposed in vessel 20, turbine-bladed type impeller 34 is mounted upon shaft 22 adjacent free end 28 so as to be rotated with rotation of the shaft. Impeller 34 typically comprises a plurality of elongated vanes 33 extending equiangularly spaced apart and generally radially outwardly from the axis of elongation of shaft 22 and also extending generally axially parallel to that axis of elongation to well beyond free end 28. In one embodiment, the tip of end 28 of the shaft is completely open or forms one large aperture 27, and those ends of the vanes that extend axially outwardly beyond the open tip of end 28 are connected together with cap 35 that extends transversely across but well spaced from the tip of end 28 so as to permit fluid flow out of aperture 27 and through the interspaces between vanes 33.

Positioned intermediate wall portions 25 and 29 so as to divide the interior of vessel 20 into two zones, 36 and 38, is substantially planar baffle plate 40 extending preferably perpendicularly to the axis of elongation of shaft 22. In the form shown in FIG. 1, baffle plate 40 is mounted on shaft 22 for rotation therewith and is dimensioned to provide a substantial clearance space 42 for fluids between periphery 44 of the plate and interior wall portion 46 of the vessel. In the embodiment shown in FIG. 2, however, the external periphery of plate 40 is mounted upon and sealed to interior wall portion 46 of the vessel, and the plate includes central aperture 48 through which shaft 22 extends, plate 40 then being dimensioned to provide a substantial fluids clearance space 50 between internal periphery 52 of central aperture 48 and shaft 22.

The portion of shaft 22 extending between opening 24 in vessel 20 and plate 40 is foraminate, being typically perforated by a plurality of apertures or openings 54 so as to provide a relatively low resistance fluid path between the interior of shaft 22 and upper zone 36.

Optionally, mounted on shaft 22 in zone 38 is rotatable mixing means in the form typically of propeller 56, for imparting mixing turbulence to a fluid mixture in that zone. One or more valved ports 58, 59 and 60 are preferably provided for introducing or removing fluid mixtures from the interior of vessel 20.

The system thus described can be used to treat a wide variety of materials with a large range of solvents or extractant fluids. For example, the apparatus of the invention can be advantageously employed in the extraction of caffeine from coffee using water-saturated fluid carbon-dioxide as the solvent as taught by Zosel in U.S. Pat. No. 3,806,619, or to extract hops with a mixture of ethanol and carbon dioxide as taught by Wheldon et al in U.S. Pat. No. 4,278,012. The apparatus of the invention has particular utility in processes for removal of oils and other contaminants from inorganic rich mineral solids such as drilling mud, sand, shale cuttings and the like with liquid Freon 12, propane or carbon dioxide as described by Eppig et al in U.S. Pat. No. 4,434,028.

In operation, vessel 20 is charged through one or more of ports 58, 59 and 60 with particulate matter that is to be extracted, in a quantity that will not completely fill lower zone 38, and solvent fluid is also introduced into the vessel concurrently with the particulate matter if the process is to be carried out on a continuous basis. Alternatively, the particulate matter and solvent can be introduced at different times where the extraction is to be a batch process. In either case, the relative proportions of solvent fluid and particulates is a matter of choice depending upon the natures of the solvent and the material to be extracted, but it is preferred that the level of the combined volume of solvent and particulate matter extends to above at least some of apertures 54 in the shaft.

Operation of motor 32 turns shaft 22, causing propeller 56 to agitate and mix the mass of particulates and fluid in zone 38 to form a sludge or slurry, moving the latter upwardly. Simultaneously, the rotation of shaft 22 whirls impeller 34 so that the vanes of the latter force the slurry of particulates and fluid outwardly away from the shaft, creating a relatively low pressure region around free end 28 in the combined volume of solids and fluid. The rotation of impeller 34 also serves to force the slurry outwardly toward the side walls of vessel 20 so that, combined with the motion of the slurry due to rotation of propeller 56, the slurry moves upwardly. As the slurry moves upwardly toward plate 40, the force of gravity will tend to cause the particles in the slurry to slow and reduce their upward velocity, so the slurry toward the top becomes comparatively solvent-rich. Most of the upward motion of the slurry will be arrested by plate 40 but some of the now solvent-rich slurry containing comparatively fine particles will be forced upwardly through clearance space 50 and into zone 36. The solvent-rich slurry in zone 36 will be drawn from the latter through apertures 54 by the relatively low pressure provided at end 28 of shaft 22 by the action of impeller 34. The solvent-rich slurry is thus drawn downwardly through shaft 22 and out of aperture 27 where its axial flow is arrested by cap 35 so as to be diverted radially outwardly through the interspaces between the impeller vanes, thus serving to recirculate the solvent again through the particulates in the slurry in zone 38.

Since certain changes may be made in the structures set forth, without departing from the scope of the invention involved, it is intended that all matter contained in the above description or shown in the accompanying drawings shall be interpreted in an illustrative and not in a limiting sense.

What is claimed is:

1. Apparatus for mixing materials, including a fluid, in a vessel, said apparatus comprising, in combination:

a hollow elongated shaft mounted for rotation about its axis of elongation and extending through one side of said vessel to a point adjacent the opposite side of the latter;

dividing means extending across said vessel intermediate the ends of said shaft substantially transversely to said axis of elongation for dividing the interior of said vessel into two zones communicating through a substantially fluid pervious clearance past an edge of said dividing means;

one end of said shaft adjacent said opposite side of said vessel having openings located in a first of said zones;

the walls of the portion of said shaft located in the second of said zones being foraminate; and means mounted on the exterior of and rotatable with said shaft for creating a relatively low pressure in the volume of said materials immediately adjacent said one end of said shaft.

2. Apparatus as defined in claim 1 wherein said means for creating a relatively low pressure comprises a plurality of impeller vanes mounted on said shaft about said one end and extending outwardly from said shaft.

3. Apparatus as defined in claim 1 wherein said dividing means comprises a baffle plate mounted within said vessel.

4. Apparatus as defined in claim 3 wherein said plate is mounted on said shaft for rotation therewith and is dimensioned to provide a substantial clearance for fluid flow between the outer periphery of said plate and the interior wall of said vessel.

5. Apparatus as defined in claim 3 wherein the external periphery of said plate is mounted upon the interior wall of said vessel, and said plate includes a central aperture through which said shaft extends, said plate being dimensioned to provide a substantial clearance between the internal periphery of said central aperture for fluid flow between the internal periphery of said aperture and said shaft.

6. Apparatus as defined in claim 1 wherein said vessel is a pressure vessel.

7. Apparatus as defined in claim 1 wherein the end of said shaft opposite to said one end is closed.

8. Apparatus as defined in claim 1 including propeller means mounted on the exterior of said shaft within said first of said zones, and being driven by rotation of said shaft.

9. Apparatus as defined in claim 1 including motor means coupled to said shaft for driving the latter in rotation about its axis of elongation.

10. Apparatus for mixing materials, including a fluid, in a vessel, said apparatus comprising, in combination:

a hollow elongated shaft mounted on said vessel for rotation about the axis of elongation of said shaft and extending through the top of said vessel to a point adjacent the bottom of the latter;

motor means coupled to said shaft for driving the latter in said rotation;

a baffle plate extending across the interior of said vessel intermediate the ends of said shaft substantially transversely to said axis of elongation for dividing said interior into upper and lower zones communicating through a substantially fluid pervious clearance past an edge of said baffle plate;

the bottom end of said shaft having at least one fluid pervious opening located in said lower zone;

a portion of said shaft located in said upper zones being foraminate; and impeller means mounted on the exterior of and adjacent said bottom end of said shaft so as to be rotatable therewith for creating a relatively low pressure in the volume of said materials immediately adjacent said one end of said shaft.

11. Apparatus as defined in claim 10 including means for directing fluid flow out of said fluid pervious opening in a direction radial to said axis of elongation.

12. Apparatus as defined in claim 11 wherein said impeller means comprises a plurality of impeller vanes mounted on said shaft about said bottom end and extending outwardly from said shaft; and said opening is so located that said means for directing can direct said fluid flow from said opening outwardly between said vanes.

* * * * *